US006945357B1

(12) United States Patent
Flux

(10) Patent No.: US 6,945,357 B1
(45) Date of Patent: Sep. 20, 2005

(54) REMOVABLE HEIGHT SAFETY APPARATUS

(75) Inventor: Peter Robert Flux, Roy Bridge (GB)

(73) Assignee: Latchways Plc., Wiltshire (GB)

( * ) Notice: Subject to any disclaimer, the term of this patent is extended or adjusted under 35 U.S.C. 154(b) by 0 days.

(21) Appl. No.: 10/018,263

(22) PCT Filed: Jun. 8, 2000

(86) PCT No.: PCT/GB00/02228

§ 371 (c)(1),
(2), (4) Date: May 14, 2002

(87) PCT Pub. No.: WO00/76590

PCT Pub. Date: Dec. 21, 2000

(30) Foreign Application Priority Data

Jun. 14, 1999 (GB) ..... 9913783

(51) Int. Cl.[7] ..... B61B 12/12
(52) U.S. Cl. ..... 182/36; 104/182
(58) Field of Search ..... 182/36, 3; 104/182, 104/112, 113, 115, 116

(56) References Cited

U.S. PATENT DOCUMENTS 5,245,931 A * 9/1993 Cuny ..... 104/182

FOREIGN PATENT DOCUMENTS

WO 02456 A * 2/1996

* cited by examiner

*Primary Examiner*—Alvin Chin-Shue
(74) *Attorney, Agent, or Firm*—Brooks Kushman P.C.

(57) ABSTRACT

A removable load transfer device 100 for use in height safety apparatus comprises:

spaced-apart rotary members 101, 102 supported for rotation with respect to each other about a common axis of rotation along which the axle extends continuously between the rotary members;

a slipper 110 defining a space 150 for receiving elongate element 250 on which the device 100 travels;

an attachment 300 for attaching a load to the device 100, and an access for element 250 includes at least one notch 117, 118 in the hub of each rotary member 101, 102 and attachment 300 includes a moveable link assembly operable between blocking and release positions with respect to notches 117, 118 by said element 250, without movement of the rotary members away from each other along the common axis, such that the attachment prevents unintended release of the load from the device.

16 Claims, 6 Drawing Sheets

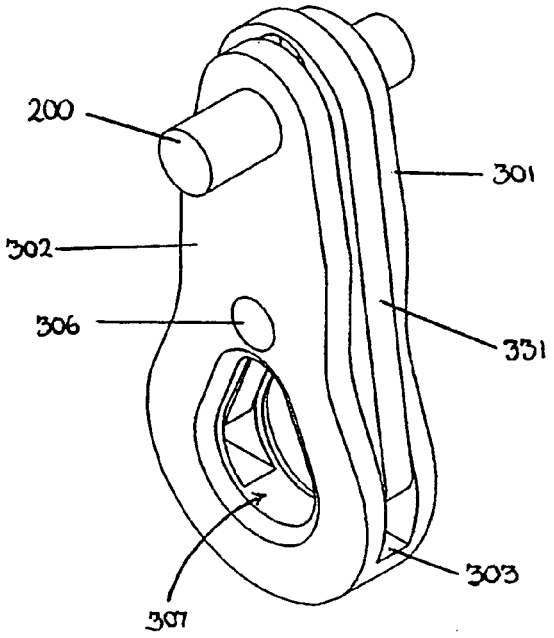
FIGURE 10
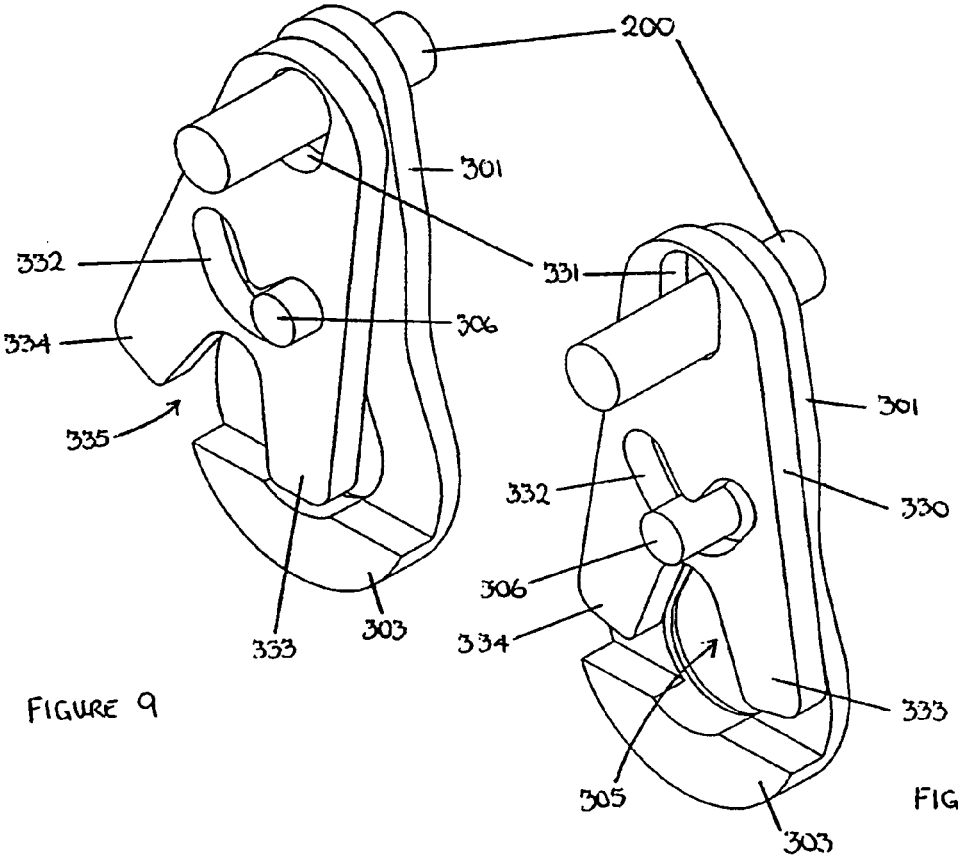
FIGURE 9
FIGURE 8

REMOVABLE HEIGHT SAFETY APPARATUS

The present invention relates to height safety equipment and, in particular, to a load transfer device which enables a person or a load to be moved along a path defined by an elongate support element, such as a safety line or cable. Typically, the elongate safety element is supported at intermediate points between its ends by brackets or attachment fittings and the load transfer device of the present invention is able to negotiate these without fouling. In particular, the invention relates to a load transfer device of the above type which is adapted for easy attachment to and detachment from the elongate support element at any point along its total span, without requiring special entry or exit fittings on the elongate support element.

Such a device has numerous applications, for example in building, mining and civil engineering for allowing personnel to move around on high structures whilst remaining attached by a personal safety harness to an elongate safety line. Alternatively, the device can be used for transferring loads along an overhead guide cable. Similar arrangements may be used in transferring goods and/or personnel from ship to shore and vice versa at quayside locations.

Some known load transfer devices suffer from the drawback that they are incapable of negotiating the intermediate brackets along the elongate support element. One solution to this problem is to provide special brackets which can be "opened" to allow the supported load to pass. The weakness of this approach is that the elongate support element temporarily lacks support at the very point where the installer thought it necessary and at the precise moment when it is most needed. Another likely problem is that the brackets may not be accessible to the system user.

An alternative solution is to employ special entry/exit fittings or access points along the elongate support element so that the load transfer device can be attached and removed. The disadvantage of this approach is that the access points are not always conveniently situated in relation to the exact location at which attachment or removal is desired.

Improved load transfer devices have been developed which are capable of automatically traversing intermediate brackets for the elongate support element without user intervention. Such devices typically comprise a pair of rotatable wheels having a series of recesses at spaced locations around their peripheries, the adjacent recesses being separated by a radially projecting part of the wheel. A co-operating shoe or slipper part is mounted on the wheels by means of formations which inter-engage with complementary formations on the radially projecting wheel parts. A space between the slipper part and the wheels is dimensioned to receive an elongate support element such as a cable or a rigid elongate element.

In use, the device is able to negotiate intermediate brackets for the elongate support element without user intervention by accommodating the bracket legs in a pair of aligned recesses carried by the respective wheels. Rotation of the wheels relative to the slipper part causes the intermediate bracket to pass behind the slipper part, in the aligned recesses of the rotating wheels.

Early versions of such devices did not address the problem of ease of attachment to or removal from the elongate support element.

However, a removable load transfer device is known from U.S. Pat. No. 5,245,931. This device has a specially-configured oblique cut-out portion formed in each of its rotating wheels to facilitate removal from and attachment to a safety line or cable. In order to effect such removal or attachment, the wheels must be aligned so that the safety line or cable can be accommodated in the cut-outs at an oblique orientation relative to the axis of rotation of the wheels. This enables the safety line or cable to be passed behind the slipper part. The disadvantage of this device is that, although it incorporates a safety feature to prevent inadvertent removal, in the form of resilient members that are slidable relative to the wheels into a position which obstructs the cut-outs, there nevertheless remains a possibility that the safety feature is inactivated whilst the device is in use. It is not designed to be fail-safe.

Another removable load transfer device is known from International Patent Application No. WO96/02456. In one embodiment described in this document, the device comprises first and second spaced-apart rotary members sharing a common axis of rotation, each having at least one recess formed in its periphery, and a co-operating slipper member that defines a space for receiving an elongate support element. In addition, the device has access means disposed between the rotary members to enable said elongate element to be introduced into or removed from said space in an orientation substantially perpendicular to the common axis of rotation of the rotary members so as to allow the device to be attached to or detached from the elongate element.

The access means is created by relative transverse movement between at least one of the rotary members and the slipper member, or between the two rotary members. In an especially preferred arrangement, which is currently being sold commercially, the body parts on which the rotary members are mounted are arranged to pivot relative to each other in a plane substantially parallel to the plane of rotation of the rotary members. At least one of the body parts has a longitudinal groove on its surface facing the other part. This groove is dimensioned to receive the elongate support element but is exposed only when the body parts are pivoted out of register. When they are aligned, the groove is obscured and access to it is prevented.

This so-called "sliding gate" arrangement is designed to be fail-safe in use because a load can only be attached to or removed from the device when the relatively slidable parts are in register. Thus, loads can never be attached to or detached from the device when the "gate" or access means is open.

Unfortunately, this known device suffers from the disadvantage that some of the manufacturing tolerances can become compounded. As a result, the device is not always as smooth in operation as ideal performance would demand. Instead of simple casting prior to assembly, some of the parts therefore require machining to ensure reliable performance. Inevitably, this drives up the cost of the device.

It is therefore an object of the present invention to provide a load transfer device for use in height safety applications which is easily attached to or detached from an elongate safety line in the absence of special entry or exit fittings and without compromising its safety performance. It is a further object of the present invention to provide a load transfer device for use in height safety applications which cannot be accidentally detached from an elongate safety line as long as a load is attached to the device. It is yet another object of the present invention to provide a load transfer device which is cheap and simple to manufacture, the constituent parts requiring little or no machining after forming.

The invention is a load transfer device comprising:

first and second spaced-apart rotary members sharing a common axis of rotation, each having a hub and at least one recess formed in its periphery;

a slipper member extending between the rotary members and defining therewith a space adapted to receive an elongate support element along which the device is adapted to travel, in use;

an attachment for attaching a load to the device; and an access that enables said elongate element to be introduced into or removed from said space so as to allow the device to be attached to or detached from the elongate element;

characterised in that said access comprises at least one notch provided in the hub of each rotary member and in that said attachment comprises a moveable link assembly operable between:

(a) a blocking position in which it prevents access to the notches by said elongate support element without movement of the rotary members away from each other along the common axis, and (b) a release position in which it allow access to the notches by said elongate support element, whereby said slipper member is enabled to pass over the elongate support element to cover or expose said space according to whether the device is being attached to or released from the elongate support element.

The arrangement of the device is such that the rotary members are rotatably mounted in relation to the slipper member. The recesses in the peripheries of the rotary members are adapted to traverse, without user intervention, an intermediate support used to support the elongate element relative to a fixed structure. This traversing operation occurs by rotation of the rotary members relative to the slipper member such that elements of the intermediate support means are successively received, guided and passed by the recesses automatically;

Most advantageously, because the moveable link forms part of the attachment, it is incapable of being deployed to its release position whenever a load is attached to the attachment. This ensures fail-safe operation of the device.

The moveable link may take a variety of forms and, in addition to the fail-safe arrangement described above, it may also be biased to its blocking position by a resilient bias such as a spring or the like. In one especially preferred form, the moveable link is formed with finger grip features to facilitate its manipulation by the user between its blocking position and its release position.

Preferably, the rotary members are in the form of wheels having a plurality of petals projecting radially from their hubs. The petals then define, between adjacent pairs thereof, recesses of the type required for automatic traversing of the elongate support element intermediate brackets. The provision of a plurality of recesses may be helpful in aligning the device with respective limbs of successive elongate support element brackets during a lengthy traverse. Although it will be understood by persons skilled in the art that the device can be made to work satisfactorily with only one notch on each rotary member, it is preferable for the number of notches in a multiple-petal variant to be the same as the number of petals. Preferably, the notches are provided at the root portions of respective petals. Such an arrangement increases the utility of the device because it provides a greater population of notches for the user to align for the attachment or detachment step. The amount of relative rotation required between the rotary members to ensure the desired alignment of the notches is never more than 360°/n, where n is the number of notches on each rotary member.

The rotary members may be provided with a formation on the respective surfaces thereof facing the slipper member, for co-operation with a complementary formation on the slipper member. This helps to maintain the relatively rotatable parts in their respective operating relationships. For example, the rotary members may each be provided with a surface groove which co-operates with complementary projections on the slipper member. Alternatively, the grooves may be provided on the slipper member and the projections on the rotary members.

One or more rollers may be incorporated in the slipper member to ease passage of the device along the elongate support element in normal use.

The important feature of all manifestations of the device is the ability to create a gap which allows the elongate support element to be introduced into or removed from the space defined between the rotary members and the slipper member.

The invention will now be described by way of example only with reference to the drawings, in which:

FIG. 8 is a similar view to FIG. 5, showing a first alternative arrangement of moveable link in the blocking or closed condition;

FIG. 9 is a similar view to FIG. 6, showing the first alternative arrangement of moveable link in the open or release condition;

FIG. 10 is a similar view to FIG. 7, with a second portion of the attachment fitting superimposed over the first alternative arrangement of moveable link;

Figure 1:
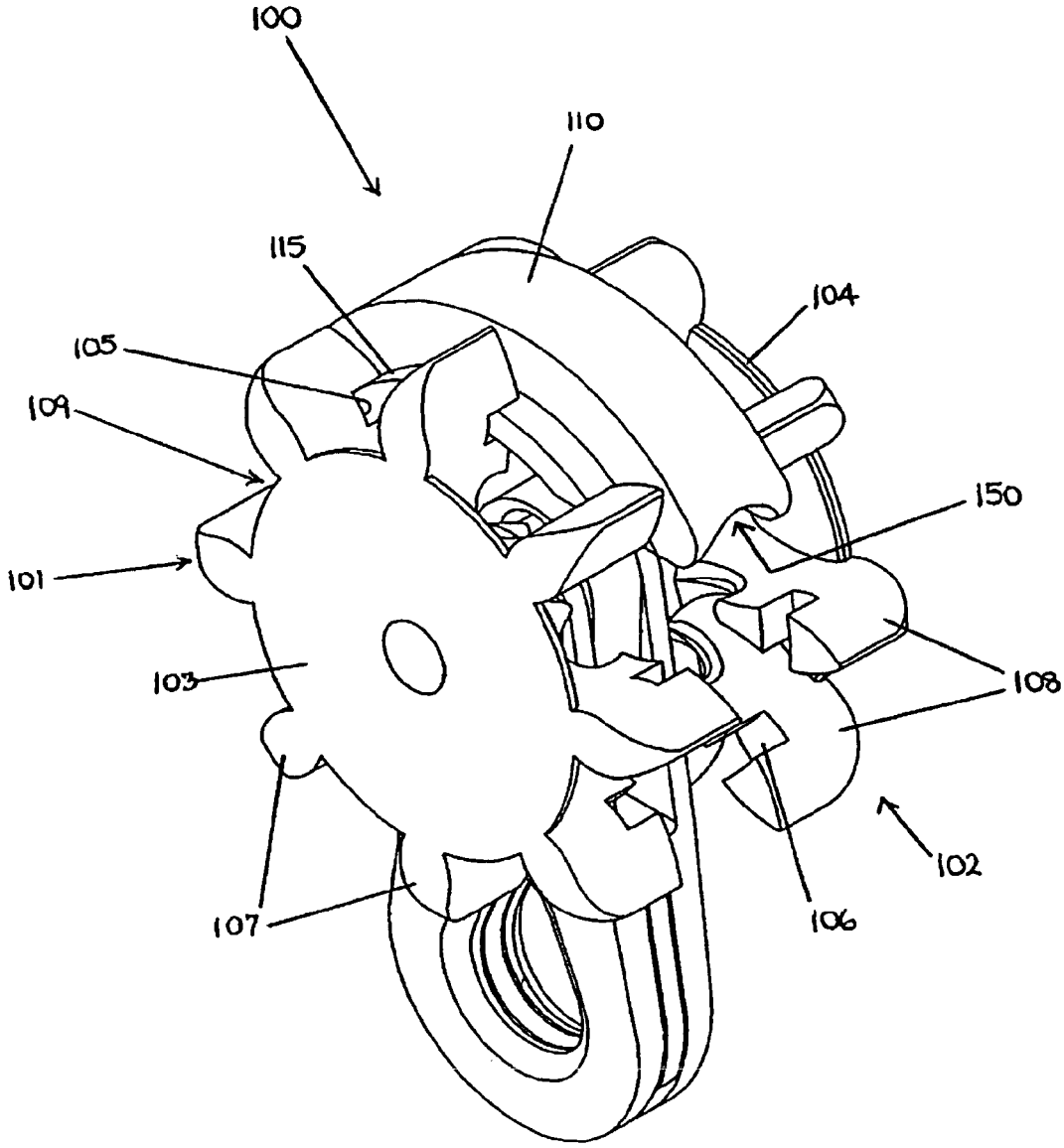
FIG. 1 is a perspective view of an embodiment of the present invention.

Referring now to FIG. 1, an especially preferred embodiment is shown of a removable load transfer device 100 constructed in accordance with the invention. The device 100 comprises a pair of rotary members in the form of so-called starwheels 101, 102 each having a respective cover member 103, 104. The cover members serve to protect the petals of the starwheels from damage in use of the device and, in other embodiments of the invention not illustrated in this document, may be fashioned to assist in aligning the device with intermediate support brackets as the device 100 travels along an elongate support element such as a wire or cable.

A slipper member 110 is located between the starwheels 101, 102. Slipper member 110 is provided with a pair of side projections 115, 116 which are engaged in complementary grooves 105, 106 formed in the respective starwheels 101, 102. In the closed condition as shown in this Figure, the combination of starwheels 101, 102 and slipper member 110 define a space 150 in which an elongate support element (not shown) is receivable in use. Between each pair of petals 107, 108 of the starwheels 101, 102 is a recess 109, the function of which will be explained in more detail below.

The device is designed to traverse intermediate support brackets for an elongate support element, typically a multi-strand steel cable, without requiring user intervention. Usually, in the vicinity of an intermediate support bracket, the elongate support element is enclosed within a guide tube and, as the device 100 approaches such a bracket, it partially entraps the guide tube. At this point, the slipper member 110 passes behind the bracket legs and does not foul on them. These legs may be any shape in cross-section provided that their cross-sectional dimension is compatible with the size of the recess 109 between adjacent petals 107, 108 of the starwheels 101, 102. The starwheels 101, 102, which lie in a similar plane to the bracket legs, offer a recess 109 between two adjacent petals 107, 108 to the bracket leg. Should the situation arise where a recess 109 is not in register with the bracket leg as the device 100 approaches the bracket, contact between a petal tip and the bracket leg causes the respective starwheel to rotate slightly and thereby bring a recess into alignment with the leg.

The bracket leg abuts against the approaching petals and rotates the starwheels, allowing the slipper member to pass behind the bracket and, ultimately, beyond it. It is to be noted that the direction of the turning force is always correct for either direction of travel of the device 100.

Figure 2:
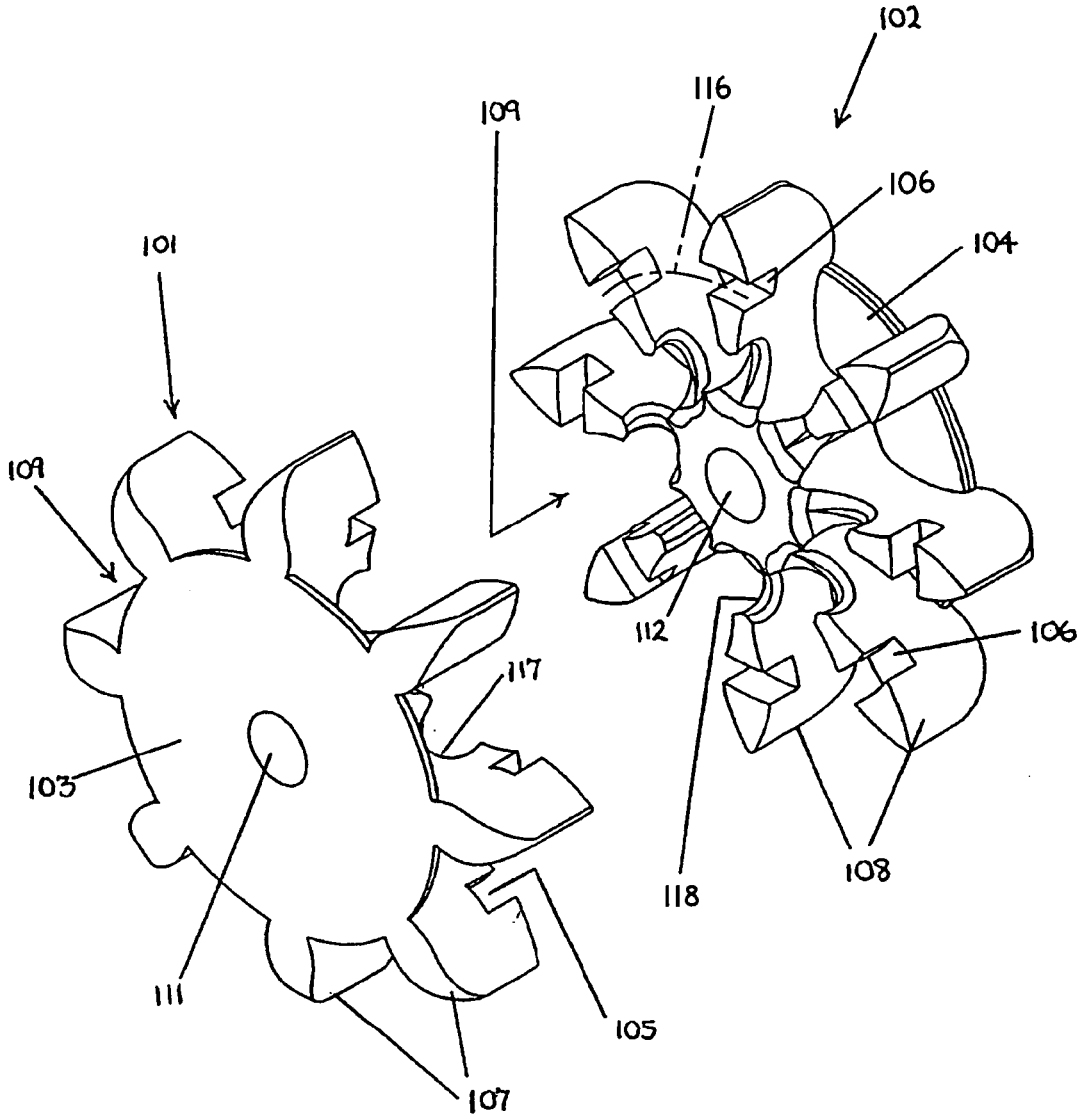
FIG. 2 is a perspective view of a pair of rotary members forming an essential part of the invention depicted in FIG. 1, shown in spaced-apart relationship.

FIG. 2 shows the starwheels 101, 102 in spaced-apart relationship, with all other parts of the device 100 removed for clarity. In the assembled device 100, the starwheels 101, 102 are rotatably mounted on a common axle 200 (FIGS. 3–11) which extends continuously between the starwheels along a common rotational axis and passes through central holes 111, 112 formed in the respective hubs of the starwheels. In the embodiment shown, each starwheel has eight petals 107, 108 and hence there are eight recesses 109 formed between the adjacent petals of each starwheel. In addition to the recesses 109, each starwheel 101, 102 has a series of notches 117, 118 at the root portions of the respective petals 107, 108. The purpose of these notches 117, 118 will be described in more detail below with reference to FIGS. 3 and 4.

Figure 3:
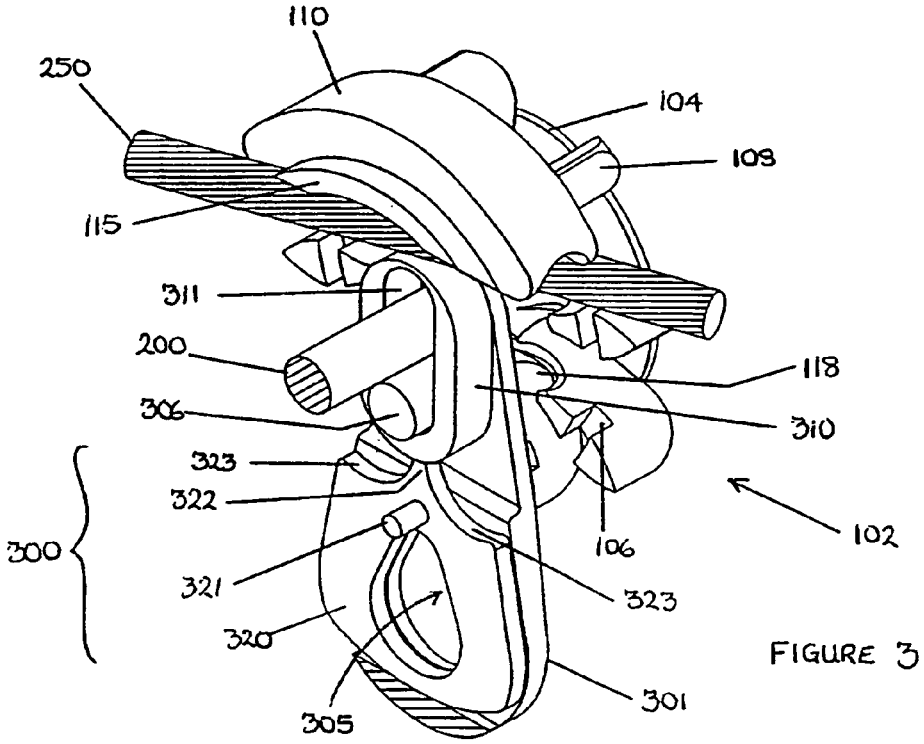
FIG. 3 is a perspective view of a part of the invention depicted in FIG. 1 in the blocking or closed condition, with one of the rotary members omitted for clarity.

Referring now to FIG. 3, this shows a first embodiment of the load transfer device according to the present invention with the starwheel 101 omitted for clarity. Starwheel 102 is rotatably mounted on axle 200, on which is also mounted attachment means 300. An attachment or attachment means 300 comprises a first attachment member 301 depending from the axle 200, said first attachment member having a connecting eye 305 adapted to receive a karabiner or similar fastening, in use, for enabling attachment of a personnel safety harness to the device by means of a lanyard. First attachment member also has a stub axle 306 positioned immediately below axle 200 on which the starwheel 102 is rotatably mounted, and a pivot pin 321 positioned above the connecting eye 305. The purposes of the stub axle 306 and the pivot pin 321 will be explained in more detail below.

Attachment means 300 further comprises a moveable link assembly comprising a moveable link 310 having an oblong slot 311 and a swing link 320 having a connecting eye 325 arranged to correspond in shape and size to the connecting eye 305 of the first attachment member 301. The oblong slot 311 of the moveable link 310 is dimensioned to accommodate both the axle 200 on which the starwheel 102 is mounted and the stub axle 306 of the first attachment member, with an additional clearance, the purpose of which will become apparent from the description which follows. The swing link 320 has a small through-hole dimensioned to receive the pivot pin 321 of the first attachment member 301 and is able to pivot thereon between a first position in which the connecting eye 325 of the swing link 320 is in alignment with the connecting eye 305 of the first attachment member 301, and a second position (best seen with reference to FIG. 4) in which the connecting eye 325 of the swing link 320 is out of register with the connecting eye 305 of the first attachment member 301. In this second position, part of the body of the swing link 320 functions as an obstructor that obstructs the connecting eye 305 of the first attachment member 301, thereby preventing attachment of a karabiner to the load transfer device.

The moveable link is shown in FIG. 3 with the lower rim of oblong slot 311 adjacent stub axle 306 and with clearance above the axle 200 on which starwheel 102 is rotatably mounted. The moveable link is maintained in this position by engagement between an upstanding lug formation 322 of the swing link 320 and the lower periphery of the moveable link.

Also shown in FIG. 3 is a short length of an elongate support element in the form of a multiple strand metal cable 250 along which the load transfer device is adapted to travel, in use. The cable 250 is slidably retained in the space 150 between the underside of slipper 100 and starwheel 102. Movement of the cable 250 in the direction towards the hub of starwheel 102 is prevented by contact of the cable 250 against the upper periphery of the moveable link 310. Thus cable 250 is prevented from being rotated obliquely relative to the load transfer device into engagement with one of the notches 118 of the starwheel 102. Such movement is only possible when the moveable link has been moved to its release position, as will now be described with reference to FIG. 4.

Figure 4:
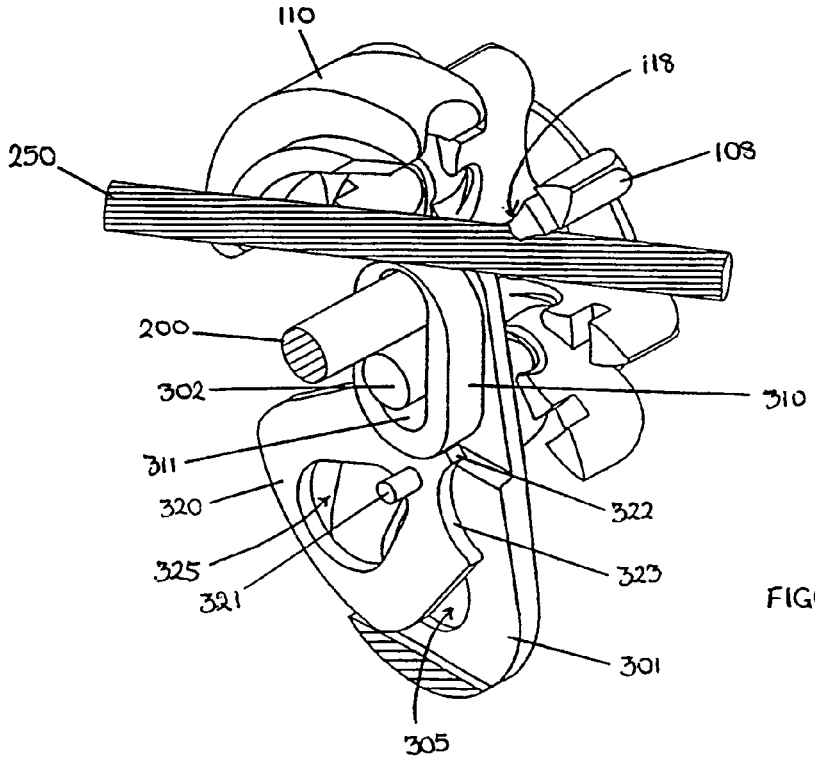
FIG. 4 is a perspective view similar to the arrangement shown in FIG. 3, but with the device in its open or release condition.

In FIG. 4, the swing link 320 is shown pivoted to its second position about pivot pin 321, such that its connecting eye 325 is no longer in register with connecting eye 305 of first attachment member 301. In this condition, it is not possible for a load to be attached to the device. Instead, it is in the condition required for attachment to or detachment from the cable 250.

Also as shown in FIG. 4, the moveable link 310 has been moved downward relative to its position previously shown in FIG. 3. Now the upper rim of oblong slot 311 is adjacent axle 200 and clearance exists below the stub axle 306 on the first attachment member 301. The upstanding lug formation 322 of the swing link 320 is no longer in contact with the lower periphery of the moveable link 310. Rather, the lower periphery of the moveable link engages one of a pair of arcuate shelf surfaces 323 formed at the top of the swing link 320, one on either side of the upstanding lug formation 322. Thus, if the swing link 320 had been pivoted in the opposite rotational sense, an equivalent release condition would have been achieved.

As a result of the downward movement of the moveable link 310 relative to the axle 200, the cable 250 is able to move closer to the hub of the starwheel 102 and can be accommodated in the notch 118 near the base of petal 108, thereby enabling the cable to be swivelled relative to the axle 200 on which the starwheel 102 is rotatably mounted. The cable 250 thus lies athwart the device, the angle between the axle 200 and the cable 250 being approximately 45° as shown in FIG. 4. When the cable 250 is disposed at such an angle relative to the axle 200, the slipper member 110 can be passed over the elongate support element to expose the space 150, thereby enabling the device to be detached from the cable 250.

For attaching the device to the cable 250, the above-described sequence of steps is carried out in the reverse order: Firstly, swing link 320 is pivoted about pivot pin 321 relative to the first attachment member 301 so that their respective attachment eyes 325, 305 are out of register. Then, moveable link 310 is moved downwards relative to axle 200 on which starwheel 102 is rotatably mounted and slipper member 110 is swung around the device to a position adjacent the attachment means 300. This exposes an access means for insertion of the cable 250. The cable 250 is inserted into the access means up to a point where it is as close as possible to the axle 200 on which starwheel 102 is rotatably mounted. Cable 250 is then rotated relative to the axle 200 so that it lies athwart the device at an angle of approximately 45° relative to the axle 200, being accommodated in one of the notches 118 at the root of a petal 108 of the starwheel 102.

It will be understood by persons skilled in the art that a second starwheel (101, not shown in FIGS. 3 and 4) is also rotatably mounted on axle 200 and that the obliquely-oriented cable is also accommodated in a corresponding notch at the base of a corresponding petal of this second starwheel.

The slipper member 110 is then swung from its position adjacent the attachment, over the cable 250, into a position corresponding to its working position. The cable is rotated in the opposite direction to its first rotational movement, so that its longitudinal axis is oriented substantially perpendicularly to the axle 200 and the device is allowed to settle on the cable 250 so that the underside of the slipper member 110 rests on top of the cable 250. The swing link 320 is pivoted about pivot pin 321 on the first attachment member 301 towards an orientation in which their respective connecting eyes 325, 305 are in alignment. This movement of the swing link 320 relative to the first attachment member 301 causes the moveable link to ride up over the arcuate shelf surface 323 of the swing link 320 to a position in which the lower rim of the oblong slot 311 of the moveable link 310 is adjacent the stub axle 306, with clearance above the axle 200. The moveable link is maintained in this position by engagement between its lower periphery and the upstanding lug formation 322 of the swing link 320.

It is only in this condition, when the respective connecting eyes 305 and 325 of the first attachment member 301 and the swing link 320 are in alignment, that a load can be attached to the device through the connecting eyes 305, 325. The cable 250 is slidably held in the space 150 defined between the starwheels, the slipper member 110 and the upper periphery of the moveable link 310. Removal of the device from the cable 250 is not possible until any load has been detached from the connecting eyes 305, 325. Hence, the device is fail-safe.

Figure 7:
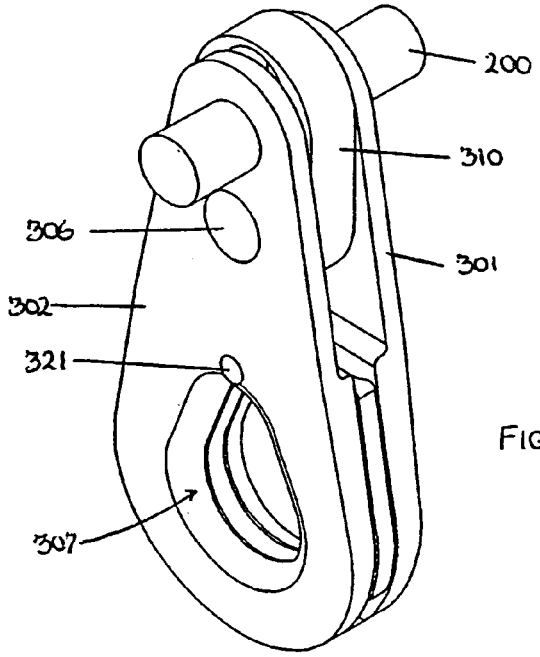
FIG. 7 is a similar view to FIG. 5, but with a second portion of the attachment fitting superimposed over the blocking or closing mechanism of the device.
Figure 6:
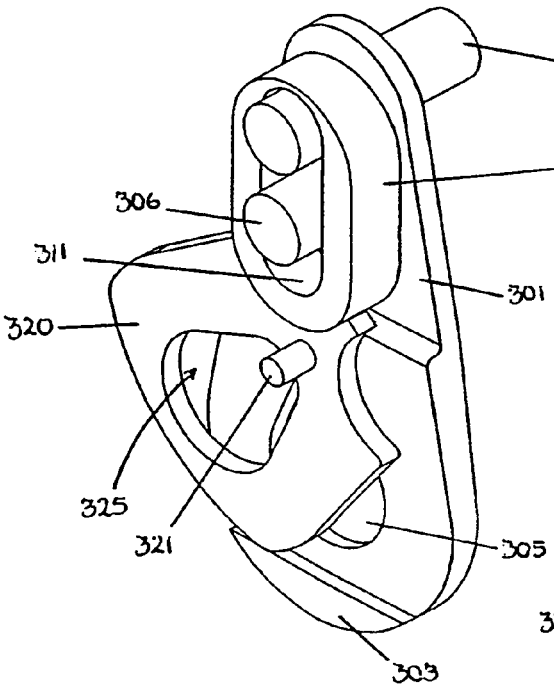
FIG. 6 is a perspective view corresponding to FIG. 4, showing the moveable link of the attachment means in the open or release condition.
Figure 5:
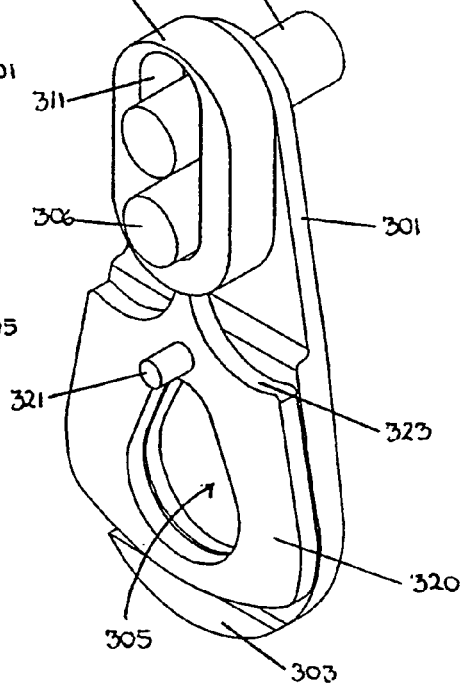
FIG. 5 is a perspective view corresponding to FIG. 3, showing the moveable link of the attachment in the blocking or closed condition.

FIGS. 5 to 7 show the attachment means 300 described above in perspective views without the presence of either starwheel, the slipper member 110, or the cable 250. Like reference numerals have therefore been used to denote the same features as previously described. FIG. 5 is a perspective view similar to FIG. 3, showing the moveable link 310 in the blocking or closed condition. In this condition, the connecting eye 325 of the swing link 305 is in alignment with the connecting eye 305 of the first attachment member 301 and the lower rim of the oblong slot 311 of the moveable link 310 is adjacent the stub axle 306. With the slipper 110 omitted from this view, it is possible to see that the upper periphery of the moveable link 310 stands proud of the upper periphery of the first attachment member 301.

FIG. 6 is a perspective view of part of the attachment means 300 corresponding to FIG. 4, showing the moveable link 310 in the open or release condition. In this view, it is possible to see how the upper periphery of the moveable link 310 is very much lower than the upper periphery of the first attachment member 301.

FIG. 7 is a perspective view of the complete attachment means 300, with the second attachment member 302 in position overlying the other components. Like its first attachment member counterpart 301, second attachment member 302 has an attachment eye 307 which is in alignment with the attachment eyes 305, 325 of the first attachment member 301 and the swing link 325, respectively, when the device is in the blocking or closed condition. The ends of stub axle 306 and pivot pin 321 can also be seen in this view and, although no longer fully visible, the moveable link is in the same position as that shown in FIG. 5.

For added safety, the first attachment member 301 has a lower web formation 303 which fills the gap between the first attachment member 301 and the second attachment member 302. This prevents any attempt to attach a load to the attachment means 300 through only one of the connecting eyes 305, 307 even when the moveable link is in the open or release condition, which is the condition required for prevention of load attachment.

FIGS. 8, 9 and 10 show an alternative arrangement of moveable link for the attachment means 300. Again, like reference numerals will be used to denote the same features as previously described.

As best seen with reference to FIGS. 8 and 9, in this alternative arrangement there is a single moveable link 330 rather than a separate moveable link and swing link. First attachment member 301 is mounted on axle 200 which is also used for rotatably mounting the starwheels that have been omitted from FIGS. 8 to 10 for clarity. First attachment member 301 has a connecting eye 305 adapted to receive a karabiner or similar fastening, in use, for enabling attachment of a personnel safety harness to the device by means of a lanyard. First attachment member 301 also has a stub axle 306 positioned below axle 200 and spaced apart therefrom.

Moveable link 330 has an oblong slot 331 in which the axle 200 is received and a substantially "V"-shaped slot 332 in which is received the stub axle 306 of the first attachment member 301. The lower portion of the moveable link 330 comprises a pair of legs 333, 334 having an inverted "V"-shaped notch 335 therebetween.

As best seen in FIG. 8, when the moveable link is in its blocking or closed condition, the axle 200 is adjacent the lower rim of oblong slot 331 and the inverted "V"-shaped notch overlies the connecting eye 305 of the first attachment member 301. In this condition, the upper periphery of the moveable link stands proud of the upper periphery of the first attachment member 301 and therefore would prevent access of a cable or similar elongate member to the cable-receiving notches (117, 118—not shown) of the starwheels (101, 102—not shown). Connecting eye 305 of the first attachment member 301 is unobstructed and is therefore able to receive a karabiner or similar fastening, for enabling attachment of a personnel safety harness to the device by means of a lanyard.

Turning now to FIG. 9, this view shows the moveable link 330 in its open or release condition. Here, it has been swung clockwise relative to the first attachment member 301. The axle 200 is adjacent the upper rim of oblong slot 331 and the stub axle 306 has moved to the end of one of the arms of the "V"-shaped slot 332. The upper periphery of moveable link 330 is now below the upper periphery of first attachment member 301 and connecting eye 305 of first attachment member 301 is obstructed by leg 334 of the moveable link 330. These are the conditions required to enable the device to be attached to or detached from an elongate support member such as a multiple strand metal cable. No load can be attached to the device through the connecting eye 305, so it is in a fail-safe condition.

FIG. 10 is a similar view to FIG. 7 described previously, with second attachment member 302 in place overlying the moveable link 330. The end of stub axle 306 can be seen and like first attachment member 301, second attachment member 302 has a connecting eye 307 for receiving a karabiner or similar fastening. Connecting eyes 305 and 307 are always in alignment but, when the moveable link 330 is in the release or open condition, one of its legs 333, 334 will obstruct the connecting eyes 305, 307 and prevent attachment of a load. When the moveable link is in its blocking or closed condition, its inverted "V"-shaped notch aligns with the connecting eyes 305, 307 leaving them unobstructed and in a suitable condition for attachment of a load.

For added safety, the first attachment member 301 has a lower web formation 303 which fills the gap between the first attachment member 301 and the second attachment member 302. This prevents any attempt to attach a load to the attachment means 300 through only one of the connecting eyes 305, 307 even when the moveable link is in the open or release condition, which is the condition required for prevention of load attachment.

Figure 13:
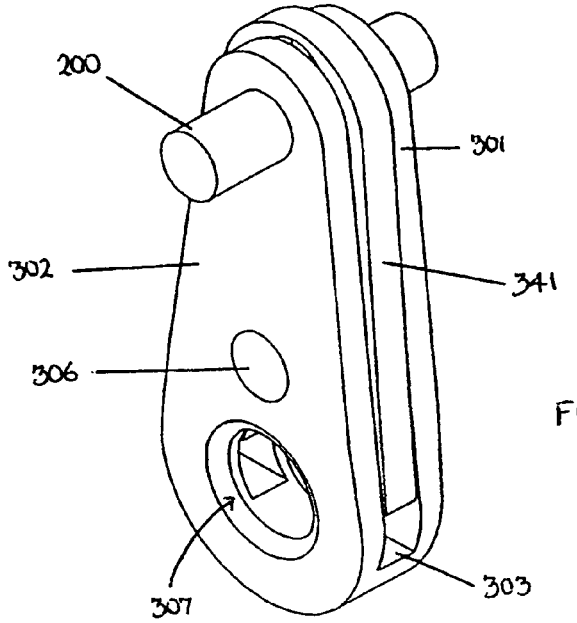
FIG. 13 is a similar view to FIG. 10, with a second portion of the attachment fitting superimposed over the second alternative arrangement of moveable link.
Figure 12:
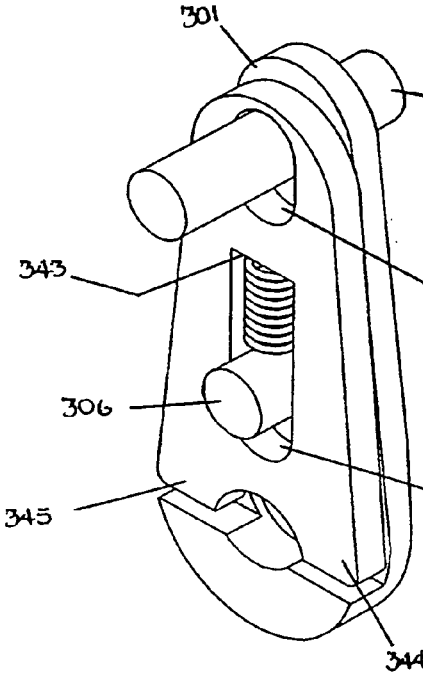
FIG. 12 is a similar view to FIG. 9, showing the second alternative arrangement of moveable link in the open or release condition.
Figure 11:
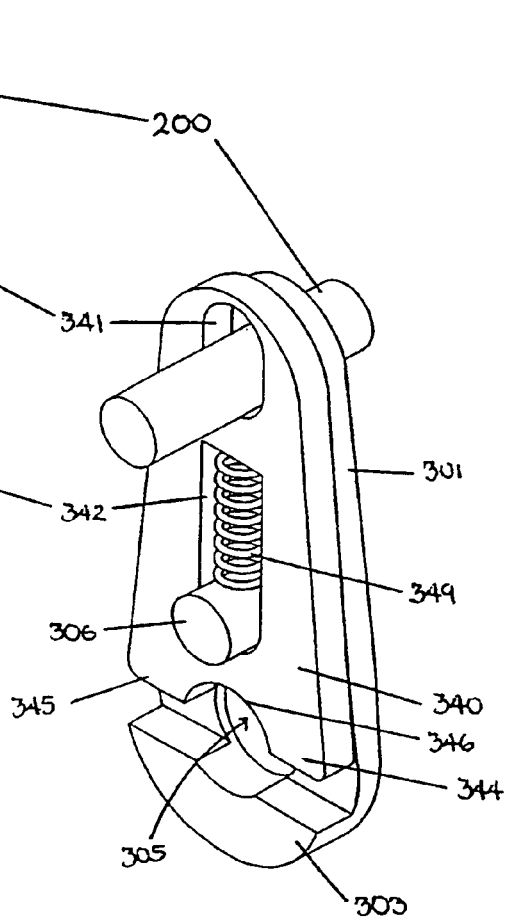
FIG. 11 is a similar view to FIG. 8, showing a second alternative arrangement of moveable link in the blocking or closed condition.

FIGS. 11, 12 and 13 show a second alternative arrangement of moveable link for the attachment means 300. Again, like reference numerals have been used to denote features corresponding to those previously described.

As best seen with reference to FIGS. 11 and 12, in this second alternative arrangement there is again a single moveable link 340 rather than a separate moveable link and swing link. First attachment member 301 is mounted on axle 200 which is also used for rotatably mounting the starwheels that have been omitted from FIGS. 11 to 13 for clarity. First attachment member 301 has a connecting eye 305 adapted to receive a karabiner or similar fastening, in use, for enabling attachment of a personnel safety harness to the device by means of a lanyard. First attachment member 301 also has a stub axle 306 positioned below axle 200 and spaced apart therefrom.

Moveable link 340 has an oblong slot 341 in which the axle 200 is received and a "U"-shaped slot 342 in which is received the stub axle 306 of the first attachment member 301, together with resilient means or bias for biasing the moveable link 340 to its blocking or closed condition. In the illustrated embodiment, the resilient means is a compression spring 349 positioned between the upper curved surface of the stub axle 306 and the underside 343 of the upper rim of the "U"-shaped slot 342. The lower portion of the moveable link 330 comprises a pair of legs 344, 345 having an inverted semicircular notch 336 therebetween.

As best seen in FIG. 11, when the moveable link 340 is in its blocking or closed condition, the axle 200 is adjacent the lower rim of oblong slot 341 and the inverted semi-circular notch 346 overlies the connecting eye 305 of the first attachment member 301. In this condition, the upper periphery of the moveable link 340 stands proud of the upper periphery of the first attachment member 301 and therefore would prevent access of a cable or similar elongate member to the cable-receiving notches (117, 118—not shown) of the starwheels (101, 102—not shown). Compression spring 349 is in its relaxed (or least compressed) condition. Connecting eye 305 of the first attachment member 301 is unobstructed and is therefore able to receive a karabiner or similar fastening, for enabling attachment of a personnel safety harness to the device by means of a lanyard.

Turning now to FIG. 12, this view shows the moveable link 340 in its open or release condition. Here, it has been moved downwards relative to the first attachment member 301. The axle 200 is adjacent the upper rim of oblong slot 341 and the stub axle 306 has moved to a position part way along the shaped slot 342, compressing the compression spring 349 to an active condition in which it acts to return the moveable link 340 to the blocking or closed condition. The upper periphery of moveable link 340 is now below the upper periphery of first attachment member 301 and connecting eye 305 of first attachment member 301 is obstructed by the upper periphery of inverted semi-circular notch 346 of the moveable link 340. These are the conditions required to enable the device to be attached to or detached from an elongate support member such as a multiple strand metal cable. No load can be attached to the device through the connecting eye 305, so it is in a fail-safe condition.

FIG. 13 is a similar view to FIG. 10 described previously, with second attachment member 302 in place overlying the moveable link 340. The end of stub axle 306 can be seen and like first attachment member 301, second attachment member 302 has a connecting eye 307 for receiving a karabiner or similar fastening. Connecting eyes 305 and 307 are always in alignment but, when the moveable link 340 is in the release or open condition, the upper periphery of its inverted semi-circular notch 346 will obstruct the connecting eyes 305, 307 and prevent attachment of a load. When the moveable link is in its blocking or closed condition, its inverted semi-circular notch 346 aligns with the connecting eyes 305, 307 leaving them unobstructed and in a suitable condition for attachment of a load.

For added safety, the first attachment member 301 has a lower web formation 303 which fills the gap between the first attachment member 301 and the second attachment member 302. This prevents any attempt to attach a load to the attachment means 300 through only one of the connecting eyes 305, 307 even when the moveable link is in the open or release condition, which is the condition required for prevention of load attachment. Of course, the second attachment member 302 could be provided with such a web formation in place of the web formation on the first attachment member 301. Alternatively, both the first and second attachment members 301, 302 could be provided with co-operating web formations to fill the gap between their lower peripheries. This arrangement has the advantage that identical castings can be used for the first and second attachment members 310, 302.

For the avoidance of doubt, it is stated here that the condition described above as the blocking or closed condition refers to the relative arrangement of the features of the invention in which attachment to or detachment from an elongate support element is prevented. In this condition, however, attachment or detachment of a load is possible.

Conversely, in the condition described above as the open or release condition, the relative arrangement of the features of the invention allows attachment to or detachment from an elongate support element, whilst preventing attachment or detachment of a load.

The conditions required for attachment to or detachment from an elongate support element, and for attachment or detachment of a load, are mutually incompatible and can never be achieved at the same time. Hence, the device is inherently fail-safe.

Although the invention has been particularly described above with reference to embodiments employing so-called starwheels, it will be understood by persons skilled in the art that this is non-limitative and that other forms of rotary member can be used. Various other modifications may also be apparent to skilled persons without departing from the scope of the claims which follow.

What is claimed is:

1. A load transfer device comprising:

first and second spaced-apart rotary members and an axle extending continuously therebetween along a common axis of rotation to provide support thereof about the common axis of rotation, each rotary member having a hub and at least one recess formed in its periphery;

a slipper member extending between the rotary members and defining therewith a space adapted to receive an elongate support element along which the device is adapted to travel, in use;

an attachment for attaching a load to the device;

an access that enables said elongate element to be introduced into or removed from said space so as to allow the device to be attached to or detached from the elongate element;

said access including at least one notch provided in the hub portion of each rotary member;

said attachment including a moveable link assembly operable between:

(a) a blocking position in which it prevents access to the notches by said elongate support element, and (b) a release position in which it allows access to the notches by said elongate support element without movement of the rotary members away from each other on the axle along the common axis, whereby said slipper member is enabled to pass over the elongate support element to cover or expose said space according to whether the device is being attached to or released from the elongate support element; and said attachment including at least a first attachment member having a first connecting eye for attaching a load to the device and wherein said moveable link assembly includes an obstructor for obstructing said connecting eye when the moveable link assembly is in the release position in which it allows access to said notches by said elongate support element.

2. A load transfer device as claimed in claim 1 wherein said moveable link assembly comprises a moveable link and a swing link, said swing link being pivotally mounted relative to said first attachment member.

3. A load transfer device as claimed in claim 2 wherein said swing link has a lug formation engageable against said moveable link to prevent movement of the moveable link until said swing link is pivoted relative to said first attachment means to a position in which engagement of said lug formation no longer occurs.

4. A load transfer device as claimed in claim 3 wherein said swing link has at least one arcuate shelf surface adjacent the lug formation, said arcuate shelf surface being adapted to cause movement of the moveable link when pivoting said swing link relative to said first attachment member to the blocking condition in which access to the notches by said elongate support element is prevented.

5. A load transfer device as claimed in claim 4 wherein said swing link has a pair of arcuate shelf surfaces, one on each side of said lug formation.

6. A load transfer device as claimed in claim 1 wherein said moveable link has an oblong slot for receipt of an axle forming said common axis of rotation for said rotary members, a substantially "V"-shaped slot for receiving a stub axle protruding from said first attachment member, and a pair of legs on its lower portion having an inverted "V"-shaped notch therebetween.

7. A load transfer device as claimed in claim 6 wherein said moveable link is pivotable relative to said first attachment member between a first position in which said inverted "V"-shaped notch is in alignment with said connecting eye, and a second position in which one of said legs obstructs said connecting eye.

8. A load transfer device as claimed in claim 1 wherein said moveable link has an oblong slot for receipt of an axle forming said common axis of rotation for said rotary members, a substantially "U"-shaped slot for receiving a stub axle protruding from said first attachment member and resilient bias for urging said moveable link to its blocking position, and a pair of legs on its lower portion having an inverted semi-circular notch therebetween.

9. A load transfer device as claimed in claim 8 wherein said resilient bias is a compression spring.

10. A load transfer device as claimed in claim 8 wherein said movable link is movable relative to said first attachment member between a first position in which said inverted semi-circular notch is in alignment with said connecting eye, and a second position in which the upper periphery of its inverted semi-circular notch obstructs the connecting eye.

11. A load transfer device as claimed in claim 1 further comprising a second attachment member overlying the movable link assembly on the other side thereof from said first attachment member, said second attachment member having a connecting eye in alignment with the connecting eye of said first attachment member.

12. A load transfer device as claimed in claim 11 wherein at least one of said first attachment member and said second attachment member includes a web formation on its periphery to fill the gap between said first attachment member and said second attachment member in order to prevent attachment of a load to the attachment through only one of the connecting eyes.

13. A load transfer device as claimed in claim 1 wherein the rotary members are in the form of wheels having a plurality of petals each of which has a root portion connected to the associated hub, and the petals projecting radially from their hubs.

14. A load transfer device as claimed in claim 13 wherein a notch is provided at the root portion of each petal.

15. A load transfer device as claimed in claim 1 wherein the rotary members are provided with a formation on the respective surfaces thereof facing the slipper member, for co-operation with a complementary formation on the slipper member.

16. A load transfer device as claimed in claim 15 wherein the rotary members are each provided with a surface groove which co-operates with complementary projections on the slipper member.

* * * * *